United States Patent [19]

Iuni

[11] Patent Number: 4,760,926

[45] Date of Patent: Aug. 2, 1988

[54] LIGHT BULB ORGANIZER AND STORAGE DEVICE

[76] Inventor: Peter Iuni, 2200 W. 121st St., Leawood, Kans. 66209

[21] Appl. No.: 141,913

[22] Filed: Jan. 11, 1988

[51] Int. Cl.[4] ..... A47F 7/00

[52] U.S. Cl. ..... 211/13; 211/99; 211/104; 312/246; 312/325

[58] Field of Search ..... 211/99, 116, 117, 104, 211/13; 312/246, 325, 322, 323

[56] References Cited

U.S. PATENT DOCUMENTS

| | | | |
|---|---|---|---|
| 3,417,874 | 12/1968 | Bryant | 312/325 X |
| 4,285,557 | 8/1981 | Paladino et al. | 312/246 |
| 4,368,937 | 1/1983 | Palombo et al. | 312/325 |
| 4,485,928 | 12/1984 | Staashelm | 211/38 X |
| 4,718,740 | 1/1988 | Cox | 312/325 X |
| 4,723,680 | 2/1988 | Carroll et al. | 312/246 X |

*Primary Examiner*—Robert W. Gibson, Jr.
*Attorney, Agent, or Firm*—John A. Hamilton

[57] ABSTRACT

A light bulb organizer and storage device consisting of a board on which light bulbs may be mounted and which may be mounted on the inner surface of a closet wall above the door opening of the closet, the board being movable from an elevated horizontal storage position above the level of the top of the door opening, in a zone normally considered to be waste space, to a lowered vertical position so that the bulbs are displayed through the door opening. The bulbs are protected against blows or other damaging contacts when the board is in the storage position. The board is provided with a spring urging it either to said storage position, or to its display position.

8 Claims, 2 Drawing Sheets

LIGHT BULB ORGANIZER AND STORAGE DEVICE

This invention relates to new and useful improvements in storing light bulbs conveniently and efficiently in space which world otherwise be largely wasted and not used for any other purpose, but which renders the bulbs instantly available, and stored in an organized manner so that any desired type of bulb is immediately available.

BACKGROUND OF THE INVENTION

Almost every householder, as well as other persons commonly involved with the replacement of burned-out light bulbs, has experienced certain problems. Light bulbs are of course fragile, and therefore must be protected until the time when their use is desired. They are also bulky, and hence together with the cartons or the like which are used to protect them, they often occupy valuable drawer or shelf space which could much better be used for other purposes. Also, there are usually several types and wattages of bulbs which must be used about a normal household, and due to the frequency with which the bulbs must be replaced, normal storage areas often become highly disorganized and helter-skelter. As a consequence, when a householder needs a particular bulb, he often must search painstakingly to determine if he even has the correct bulb in storage, and often finds that he does not, even when he believed that he did, and even then may find that the bulb has been broken or damaged by rough handling during storage. The provision of a convenient, safe and efficient device for storing the bulbs, within a space which is normally unused and wasted, but which renders the bulbs conveniently and immediately available, would therefore obviously be a useful and valuable contribution to the art.

SUMMARY OF THE INVENTION

The principal object of the present invention is the provision of a light bulb storage device consisting of a storage board on which light bulbs may be mounted, normally in screw sockets for security, which may be easily moved from one position in which the bulbs are effectively shielded from blows or other damaging contacts, to a position in which the bulbs are displayed for ready identification and accessibility.

Another object is the provision of a device of the character described in which the storage position of the light board is disposed in a space which is ordinarily considered to be waste space, for example a closet but above the level of the top of the closet door, and the display position of the board is vertical within the closet door opening, so as to be readily accessible.

A further object is the provision of a device of the character described in which the display board is movable between the storage and display positions by simple manual pressure exerted thereon, and will automatically be retained in either position to which it is moved.

Other objects are simplicity and economy of construction, and efficiency and dependability of operation.

With these objects in view, as well as other objects which will appear in the course of the specification, reference will be had to the drawing.

DESCRIPTION OF A PREFERRED EMBODIMENT

Figure 1:
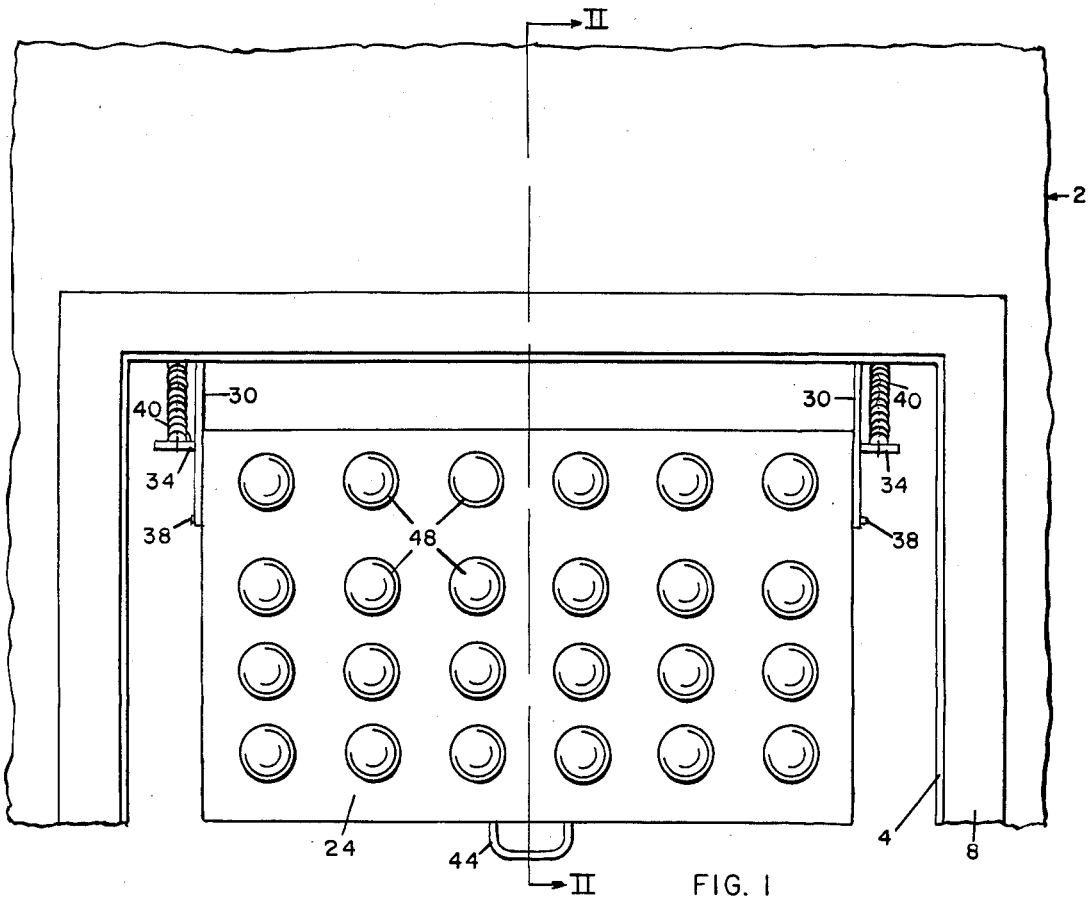
FIG. 1 is a fragmentary elevational view of the top portion of a closet door, and including a light bulb organizer and storage device embodying the present invention, being shown in its light bulb display position.
Figure 3:
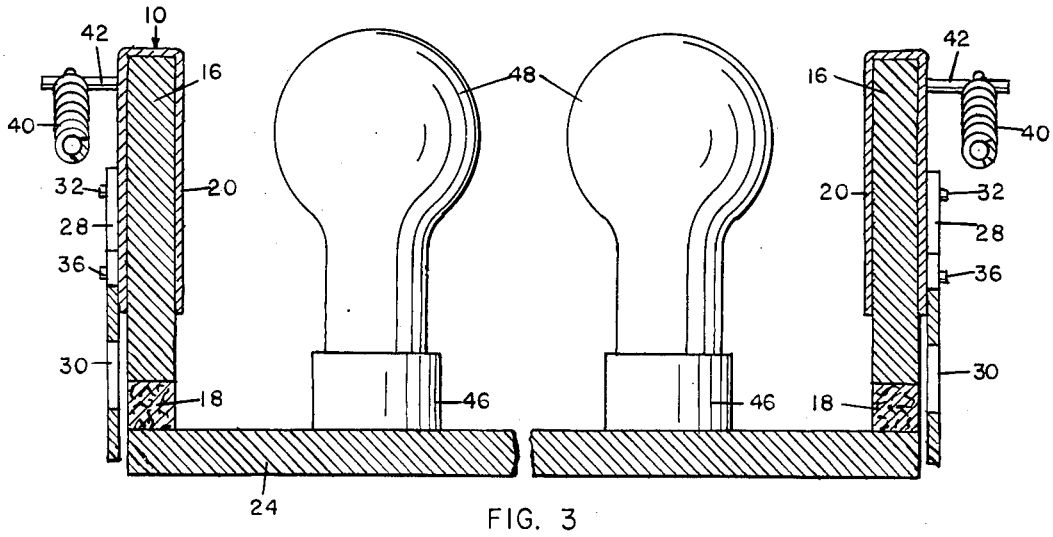
FIG. 3 is an enlarged, horizontally foreshortened sectional view taken on line III—III of FIG. 2.

Like reference numerals apply to similar parts throughout the several views, and the numeral 2 applies generally to a structural wall, such as a closet wall of a dwelling, having a door opening 4 formed therein, the interior surface of said wall being shown at 6, and the door opening having a frame 8. The device contemplated by the present invention includes a frame indicated generally by the numeral 10 which comprises a board 12 extending horizontally above the closet door frame, and secured to the inner surface 6 of wall 2 by screws 14 (one shown), and a pair of boards 16, each of boards 16 being affixed at its forward end to one end of board 14. Boards 16 are inclined upwardly and rearwardly into the interior of the closet in parallel relation, and spaced apart by a distance less than the width of door opening 4. The straight lower edge of each board 16 has a layer 18 of felt, foam rubber, or other satisfactory cushioning material affixed thereto. The upper edge of each board 16, adjacent its forward end, may have a metal cover 20 affixed thereto, as by screws 22, in order to provide for more secure attachment for various elements to be attached thereto, as will appear.

A rectangular display and mounting board 24, is wide enough to extend beneath the cushion strips 18 of both of boards 16, and to extend substantially the full length of boards 16. Board 24 normally is pressed upwardly against cushion strips 18, having full line contact with said cushion strips, and has a downward extension board 26 affixed thereto along the rearward portion of each of its side edges. Board 24 is attached at each of its side edges to the associated frame side board 16 by a pair of links 28 and 30, both of said links extending generally horizontally when the device is in the storage position as shown in solid lines in FIG. 2. Link 28 is pivoted at its forward end to metal cover 20, as at 32, and at its rearward end to the associated extension board 26 at that side of board 24, as at 34. Each link 30 is pivoted at its forward end to cover 20, as at 36, and is pivoted at its rearward end to the associated extension board 26, as at 38. Corresponding pivots 32, 34, 36 and 38 at opposite sides of board 24 are coaxial, and all of the pivotal axes are horizontal and transverse to board 24. Also, at each side of the board, a helical tension spring 40 is extended under tension between pivot 34 of link 28 and a pin 42 affixed in the associated metal cover in spaced apart relation above pivot 32 of link 28.

Mounted on the lower surface of board 24, closely adjacent its forward edge, is a depending handle member 44. Mounted on the top surface of said board are a large number of lamp sockets 46, into each of which a light bulb 48 may be threaded to mount it firmly in place relative to board 24. Each of said sockets is intended only as a mounting for a bulb, and is not provided with electrical connections.

Figure 2:
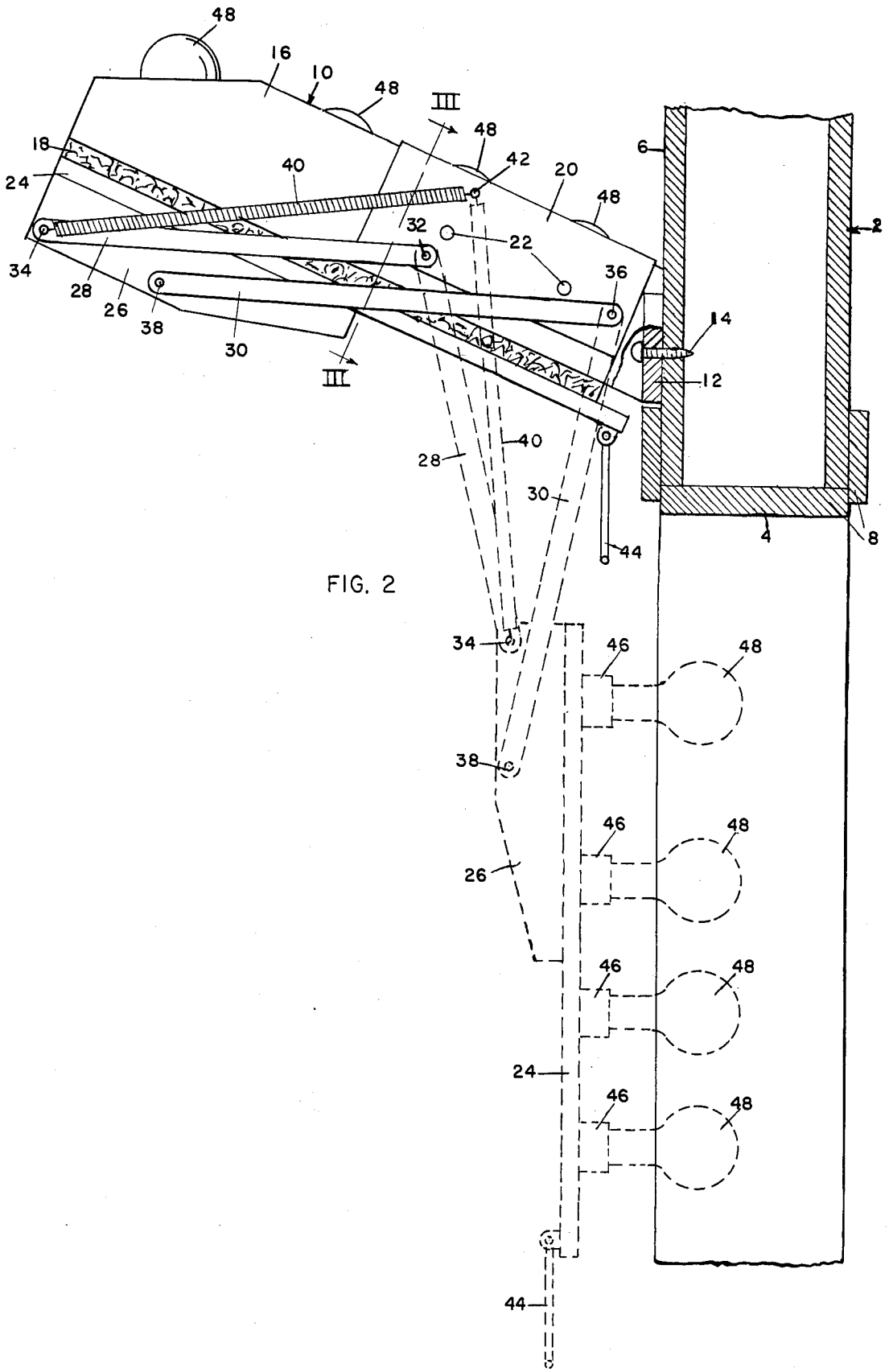
FIG. 2 is an enlarged fragmentary sectional view taken on line II—II of FIG. 1, showing the device contemplated by the present invention in its storage position in solid lines, and in its display position in dotted lines, with the storage device shown principally in elevation.

In operation, it will be seen that in the storage position shown in solid lines in FIG. 2, springs 40, being disposed above the axis of link 28, exerts an upward pressure holding board 24 firmly upwardly against the cushion strips 18 of side boards 16, and that bulbs 48 project upwardly between side boards 16, which thus protect the bulbs against blows or other damaging contact with anything which might normally move about in the closet. When the user desires to obtain access to a bulb, he grasps handle 44 and pulls downwardly. The links 28 and 30 thus cause board 24 to be lowered and tilted forwardly until board 24 is disposed generally vertically with bulbs 48 facing forwardly through door opening 4, as shown in dotted lines in FIG. 2, and as shown in FIG. 1. During this movement, springs 40 pass over a dead center position relative to the axes of links 28, so that said springs then urge board 24 forwardly to retain it in the display position. Any significant forward overtravel of the board is prevented by engagement between links 30 and links 28 adjacent pivots 34. The user may then identify and remove the particular bulb he needs. The arrangement of the sockets 46 on board 24 may be selected and systemitized as to size and spacing to allow for the storage therein of bulbs of many different sizes, wattages and base thread arrangements. The user then may press upwardly on the lower edge of board 24 to return it to its storage position as shown in solid lines, with cushion strips 18 absorbing any shock which might otherwise occur if board 24 should directly engage the lower edges of boards 16 as it returns to the storage position.

While I have shown and described a specific embodiment of my invention, it will be readily apparent that many minor changes of structure and operation could be made without departing from the spirit of the invention.

What I claim as new and desire to protect by Letters Patent is:

1. A light bulb organizer and storage device comprising:

a. a frame adapted to be mounted in a fixed position relative to a structural wall, b. a generally planar board, c. means mounting a plurality of light bulbs on one surface of said board, and d. means connecting said board movably to said frame, whereby said board may be moved between an elevated, generally horizontal storage position and a lowered, generally vertical display position.

2. A device as recited in claim 1 wherein said structural wall constitutes a closet wall having a door opening formed therein, and wherein said frame is mounted on said wall at the inner side thereof and above the top of said door opening, the side of said board carrying said light bulbs facing upwardly when in said storage position, and facing outwardly through said door opening when in its display position.

3. A device as recited in claim 1 wherein said means mounting said light bulbs on said board constitutes a series of sockets fixed on said board and into which the base of a light bulb may be threaded, whereby said bulbs are maintained firmly relative to said board and in spaced apart relation from each other.

4. A device as recited in claim 2 wherein said board engages said frame when in said storage position, and wherein said frame includes a pair of side boards rising from the lateral edges of said board when the latter is in said storage position, whereby to protect said bulbs from blows or other damaging contacts.

5. A device as recited in claim 4 with the addition of cushioning members interposed between said board and said frame whereby to cushion any shock as said board is moved to its storage position and engages said frame.

6. A device as recited in claim 2 wherein said means connecting said board to said frame comprises a pair of links extending between and pivoted at their respective ends to said board and said frame at each of the lateral sides of said board, said links being of such relative lengths that they move said board between said horizontal storage position and said vertical display position as said board is respectively raised and lowered.

7. A device as recited in claim 6 with the addition of one or more tension springs interconnecting said frame and said board and arranged to pass over a dead center position relative to the axis of at least one of said links at a position of said board intermediate its storage and display positions, whereby to urge said board to both its storage and display positions.

8. A device as recited in claim 2 with the addition of a handle secured to said board at the edge thereof closest to said structural wall, and depending therefrom to a level slightly below top of the door opening of said wall, whereby to serve as a visual indicator to the user.

* * * * *